US007657003B2

(12) United States Patent
Adams

(10) Patent No.: US 7,657,003 B2
(45) Date of Patent: Feb. 2, 2010

(54) X-RAY TUBE WITH ENHANCED SMALL SPOT CATHODE AND METHODS FOR MANUFACTURE THEREOF

(75) Inventor: William L. Adams, Powell, OH (US)

(73) Assignee: Thermo Niton Analyzers LLC, Billerica, MA (US)

( * ) Notice: Subject to any disclaimer, the term of this patent is extended or adjusted under 35 U.S.C. 154(b) by 0 days.

(21) Appl. No.: 12/204,643

(22) Filed: Sep. 4, 2008

(65) Prior Publication Data

US 2009/0060142 A1 Mar. 5, 2009

Related U.S. Application Data

(60) Provisional application No. 60/969,926, filed on Sep. 4, 2007.

(51) Int. Cl.
*H01J 35/06* (2006.01)

(52) U.S. Cl. ..... 378/136

(58) Field of Classification Search ..... 378/119, 378/121, 136–138, 143
See application file for complete search history.

(56) References Cited

U.S. PATENT DOCUMENTS 6,320,932 B2 11/2001 Dinsmore
7,236,568 B2 6/2007 Dinsmore et al.
2005/0136185 A1 * 6/2005 Ramanathan et al. ..... 427/299

OTHER PUBLICATIONS

TWX, LLC, "twX Forty KiloVolt X-Ray Tube," twX product description web page, http://www.twxray.com/products.cfm, pp. 1-2, (2006).

* cited by examiner

*Primary Examiner*—Irakli Kiknadze
(74) *Attorney, Agent, or Firm*—Sunstein, Kann, Murphy & Timbers; Charles B. Katz

(57) ABSTRACT

An x-ray source produces a well-defined electron beam, without an undesirable halo. The x-ray source includes a housing, a cathode disposed within the housing, an anode spaced apart from the cathode for accelerating electrons emitted from the cathode and an x-ray emitter target disposed within the housing and spaced apart from the cathode for impact by the accelerated electrons. The cathode includes a passivation layer over only a portion of the area of the cathode, leaving an emission portion of the cathode that is not passivated. The passivation layer reduces or prevents emissions from the passivated portion of the cathode, thereby preventing a halo, which would otherwise be produced by lower-level emissions from the portion of the cathode that surrounds the emission portion of the cathode.

16 Claims, 3 Drawing Sheets

X-RAY TUBE WITH ENHANCED SMALL SPOT CATHODE AND METHODS FOR MANUFACTURE THEREOF

CROSS REFERENCE TO RELATED APPLICATIONS

This application claims the benefit of U.S. Provisional Patent Application No. 60/969,926, filed Sep. 4, 2007, titled "X-Ray Tube with Enhanced Small Spot Cathode and Methods for Manufacture Thereof," the entire contents of which are hereby incorporated by reference herein, for all purposes.

TECHNICAL FIELD

The invention relates generally to x-ray tubes and, more particularly, to x-ray tubes having cathodes configured to produce small electron beam spots on targets, without producing halos surrounding these spots.

BACKGROUND ART

A typical miniature x-ray tube includes an evacuated ceramic tube with a cathode structure at one end of the tube and an anode structure at or near an opposite end of the tube. Traditionally, the cathode is heated to facilitate releasing electrons, and a high-voltage electric field is established between the cathode and the anode to accelerate the released electrons toward, and possibly beyond, the anode. There may be a short focusing element within the tube. If present, the focusing element includes electrically conducting material for creating an electric field. The focusing element is formed such that the electric field tends to concentrate the flow of electrons into a compact stream. The effectiveness of any focusing depends to a significant degree on the size of the area on the cathode from which the electrons are emitted. The smaller the area, the easier it is to develop a well defined small spot on the target.

The electron beam strikes a target at the far end of the ceramic tube, resulting in the production of x-rays. The target may be the anode or another structure. The target usually includes a thin, heavy metal coating, such as gold (Au) or tungsten (W), on the surface of a material that allows the x-rays to pass through with little attenuation. In some cases, the x-ray beam may be taken off of a more conventional solid, x-ray opaque target at an angle as scattered x-rays. In either case, the x-rays are produced from a spot on the target where the electron beam strikes the target.

To improve electron emissions from cathodes, most cathodes are now made from thoriated tungsten using a process described by Langmuir. In that process, about 2% thorium oxide is mixed with tungsten. Cathodes made of this material are then "activated" by heating them to about 2800 degrees Kelvin (K), which reduces any thorium oxide to a mono layer of metallic thorium on the surface of the tungsten. Carbon is added to the surface to carbonize some of the tungsten to tungsten carbide, which limits the rate of evaporation of the thorium from the surface. The result is a cathode that has several orders of magnitude more emission than pure tungsten. Other details regarding construction of prior-art miniature x-ray tubes are disclosed in U.S. Pat. No. 7,236,568.

In many applications, it is important that the area or a dimension of the spot on the target is as small as possible. However, it has been found that a conventional x-ray tube produces a spot of x-ray emissions surrounded by an undesirable "halo" of x-ray emissions, as a result of heat spreading in the cathode, as described in the following paragraphs.

Traditionally, the cathode is either a directly heated filamentary cathode or a planar cathode. U.S. Pat. No. 6,320,932 discloses heating a cathode by a laser light source. The use of a laser heat source makes planar cathodes easier to implement. In addition, heating a small area in the center of a thin metal cathode gives a more intense emission from the heated area than from unheated areas. An electron beam spot on the order of a few hundred microns in diameter is achievable using a laser-heated planar cathode.

However, heat is conducted from the central, directly heated area of the cathode to adjacent portions of the cathode, which causes the cooler portion of the cathode to emit electrons, albeit at a much lower rate, such as about 1/20 to about 1/100 that of the central, directly heated part of the activated cathode area. This results in a "halo" around the x-ray spot on the target. In a miniature x-ray tube, an exemplary cathode is on the order of 2-3 mm in diameter, and the central electron beam is about 0.2 mm in diameter. Thus, the area of the halo may be approximately 100 times the area of the central spot. Such a halo forms an undesirable background in a measurement.

SUMMARY OF THE INVENTION

An embodiment of the present invention provides an x-ray source with an enhanced small spot cathode. Such an x-ray source includes a housing, a cathode disposed within the housing and an anode spaced apart from the cathode. The cathode has an area and a passivation layer over only a portion of the area. The anode is adapted for a voltage bias with respect to the cathode for accelerating electrons emitted from the cathode. The x-ray source also includes an x-ray emitter target disposed within the housing. The x-ray emitter target is spaced apart from the cathode for impact by the accelerated electrons. The passivation layer may include a pyrolytic material, such as platinum or tantalum. The cathode may also include a thoriated tungsten layer. The portion of the cathode that is not covered by the passivation layer may be activated, such as with carbon.

Another embodiment of the present invention provides a method for manufacturing a cathode for an x-ray source. The method includes providing a base layer that has an area and passivating only a portion of the area of the base layer, thereby defining an emission portion of the base layer.

Passivating the portion of the base layer may include applying a pyrolytic material, such as platinum or tantalum, to the portion of the base layer. Providing the base layer may include providing a thoriated tungsten layer. The method may also include activating at least an emission portion of the thoriated tungsten layer, such as by activating the emission portion with carbon.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

In accordance with preferred embodiments of the present invention, an x-ray source with an enhanced small spot cathode is disclosed, as well as methods for manufacturing such an x-ray source. Such an x-ray source overcomes the halo problem, and corresponding undesirable background, of prior art x-ray tubes, while retaining the high emissivity, and well-defined central beam, of an activated thoriated tungsten cathode with a small activated area.

As noted, in many applications, it is important that the area or a dimension of the x-ray spot of an x-ray source is as small as possible. The size of the x-ray spot on the target depends largely on the size of the area from which electrons are emitted from the cathode and any focusing or dispersion that takes place as the electrons transit to the target. In the case of miniature x-ray tubes, such as x-ray tubes produced by North Star Imaging, Inc., Rogers, Minn., Moxtek, Inc. Orem, Utah and twX, LLC, West Concord, Mass., the electric field structure is such that the electron beam spreads very little in transit to the target. The electron beam spot on the target is, therefore, a relatively faithful image of the cathode emission area, with a very slight size change.

Figure 1:
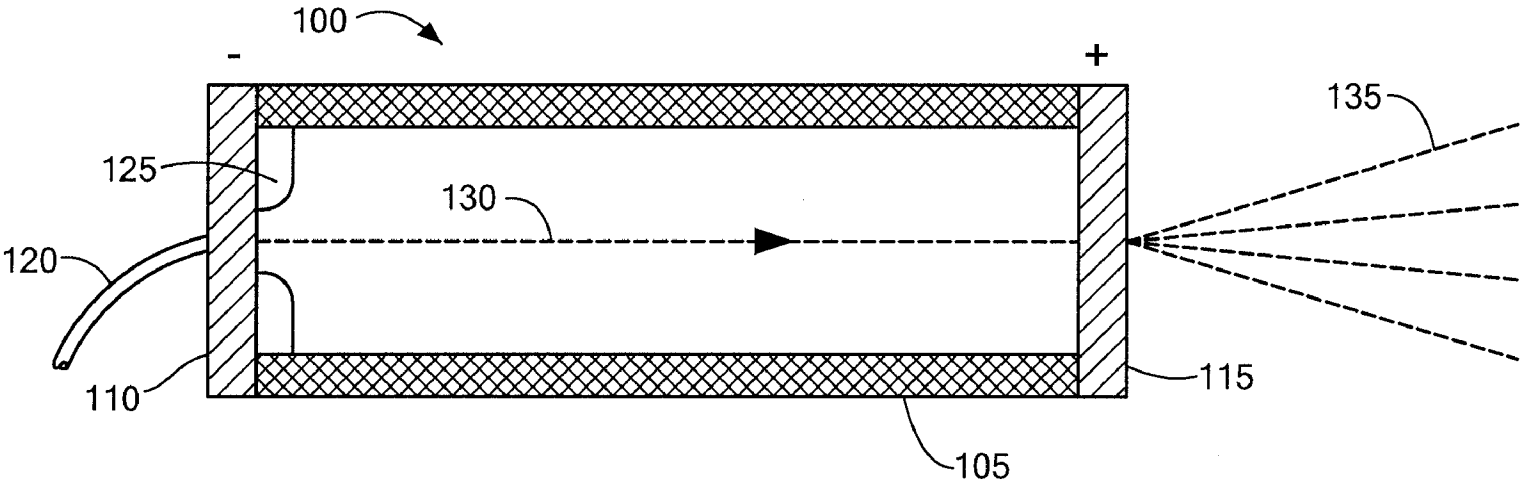
FIG. 1 is a longitudinal cross-sectional view of an x-ray tube, according to one embodiment of the present invention.

FIG. 1 is a longitudinal cross-sectional schematic diagram of an x-ray tube 100, according to one embodiment of the present invention. The x-ray tube includes a ceramic tube 105, a thoriated tungsten cathode 110 and a target 115. The cathode 110 and an anode on the target 115 are connected to an appropriate high-voltage power supply (not shown). The cathode 110 may be heated via an optical fiber 120 coupled to a laser heat source (not shown), by a filament (not shown) or by another structure. The x-ray tube 100 may include a focusing system 125. An electron beam 130 emitted from the cathode 110 strikes the target 115 to produce x-rays 135.

Figure 3:
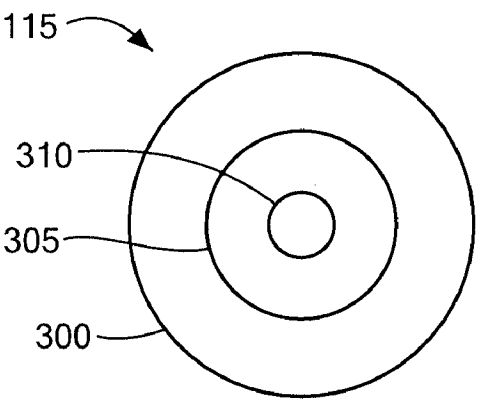
FIG. 3 is an end view of a target of the x-ray tube of FIG. 1.

FIG. 3 is an end view (as viewed from within the ceramic tube 105) schematic diagram of the target 115 of the x-ray tube of FIG. 1. The target 115 includes a metal support 300 vacuum sealed to the ceramic tube 105. To the target 115 is attached an anode 305, typically made of gold (Au) or tungsten (W) coated on a sufficiently x-ray transparent material. In operation, the electron beam 130 (FIG. 1) strikes the target 115 to create an image spot 310 of the cathode 110.

Figure 2:
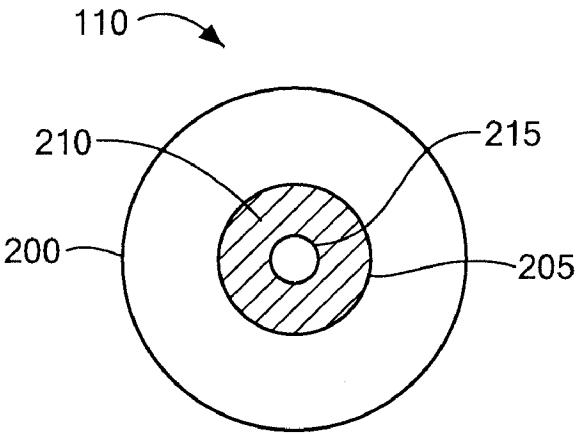
FIG. 2 is an end view of a cathode of the x-ray tube of FIG. 1.
Figure 4:
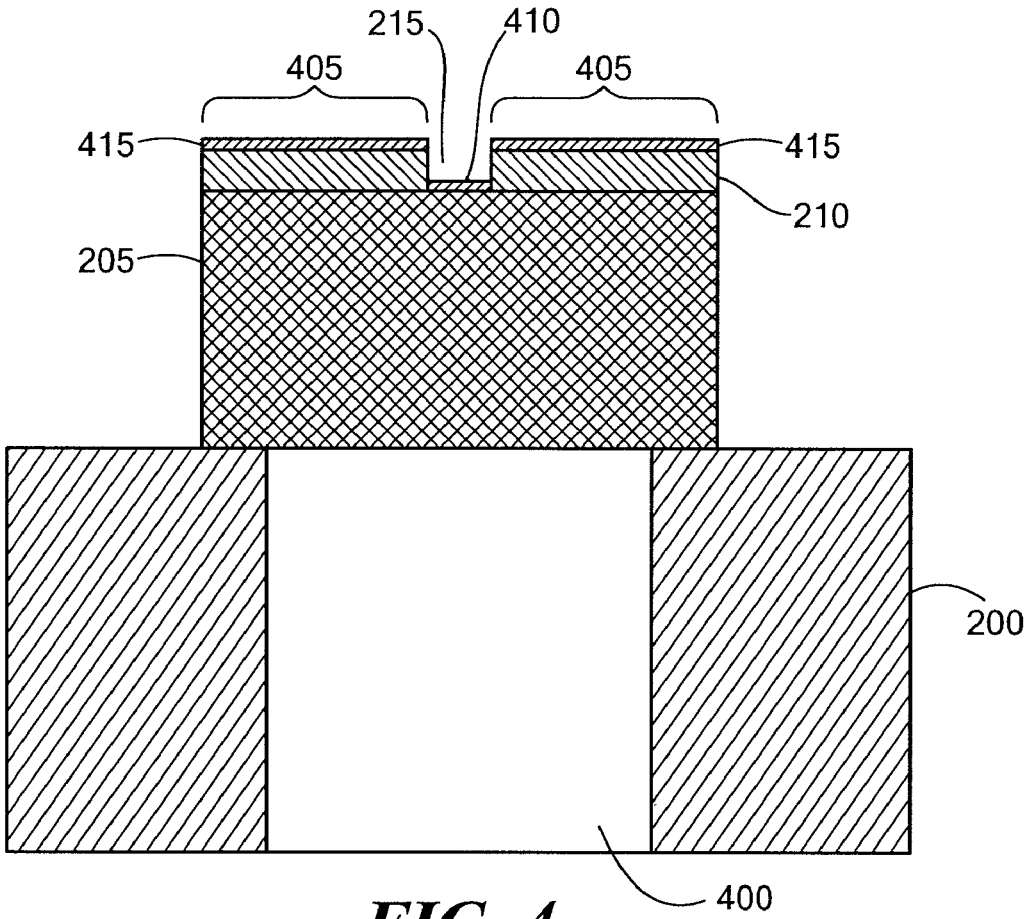
FIG. 4 is a cross-sectional view of the cathode of FIG. 2.

FIG. 2 is an end view (as viewed from within the ceramic tube 105) schematic diagram of the cathode 110, and FIG. 4 is a cross-sectional schematic diagram of the cathode 110. The cathode 110 includes a metal support 200 vacuum sealed to the ceramic tube 105. An apx. 100 μm thick, apx. 2-3 mm diameter, thoriated tungsten disk 205 is attached to the center of the support 200. The disk 205 is made of thoriated tungsten and is supported so that the disk 205 may be heated. The metal support 200 defines an aperture 400 (FIG. 4), in which the optical the optical fiber 120 (not shown) may terminate.

In the illustrated embodiment, the cathode 110 is passivated by an apx. 10-30 μm thick layer 210 of pyrolytic material, such as platinum or tantalum, except for a small (apx. 150 μm diameter) area 215, from which desired emissions take place. Considerations for selecting an appropriate passivation material are discussed below. The emission area 215 is activated, as discussed below, and may be circular or any other desired shape. The passivation 210 eliminates or substantially reduces the halo effect described above, while precisely defining the area 215 of emission.

Platinum and tantalum are well-suited passivators, because both materials have work functions greater than that of thoriated tungsten. Platinum has a work function of approximately 6.3 eV, and tantalum has a work function of approximately 4.1 eV, whereas thoriated tungsten has a work function of approximately 2.6 eV. Thus, emissions from the platinum-passivated or tantalum-passivated area 405 are several orders of magnitude less than emissions from the activated thoriated tungsten portion 215. The emissivity of various material can be estimated using the Richardson-Dushman equation (1):

$$I=AT^2e^{-b_0/T} \quad (1)$$

where:

I=current in amperes per $cm^2$;

A=constant determined by the material;

T=temperature in degrees Kelvin (K); and $b_0$=11,600×(work function).

The passivation material 210 may be selectively deposited on the thoriated tungsten disk 205 using any appropriate technique, such as vacuum deposition using a small mask in the area 215 of the emission portion of the cathode 110, masking and electrodeposition, or a technique used in micro-electro-mechanical systems (MEMS) fabrication.

Once the disk 205 is fabricated with the passivated area 210, the emission portion 215 of the cathode 110 may be activated using any appropriate technique, such as depositing carbon on the emission portion 215 of the cathode 110, yielding an activation layer 410. Most activation techniques cause carbon 415 to also be deposited on top of the passivation layer 210. However, platinum and tantalum are not activated by carbon. Thus, the platinum or tantalum passivation layer 210 serves as a passivator and prevents a halo, even if the platinum or tantalum is coated with carbon 415.

Figure 5:
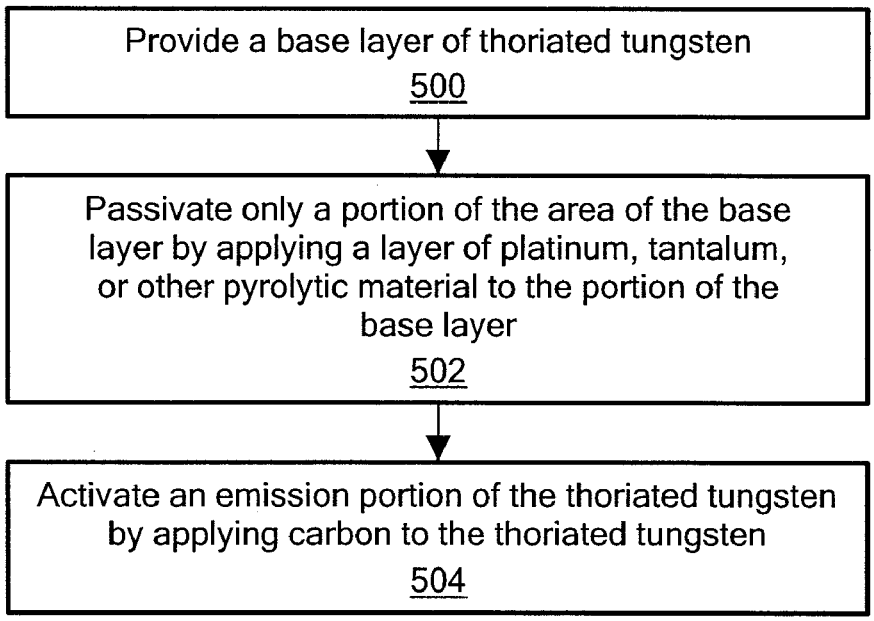
FIG. 5 is a flowchart describing a process for manufacturing a cathode for an x-ray source, according to one embodiment of the present invention.

FIG. 5 is a flowchart of a process for manufacturing a cathode for an x-ray source, according to one embodiment of the present invention. At 500, a base layer of thoriated tungsten is provided. The thoriated tungsten base layer may be a circular disc or another shape. The thoriated base layer may be attached to, or otherwise supported by, a metal or other suitable support. At 502, a portion of the base layer is passivated, such as by applying a layer of platinum, tantalum or other pyrolytic material to the portion of the base layer. An unpassivated portion, i.e. an emission portion, of the base layer is defined by the passivation layer. The emission portion may be circular or another shape. At 504, the emission portion of the thoriated tungsten is activated by applying carbon or another suitable material to the thoriated tungsten.

Figure 6:
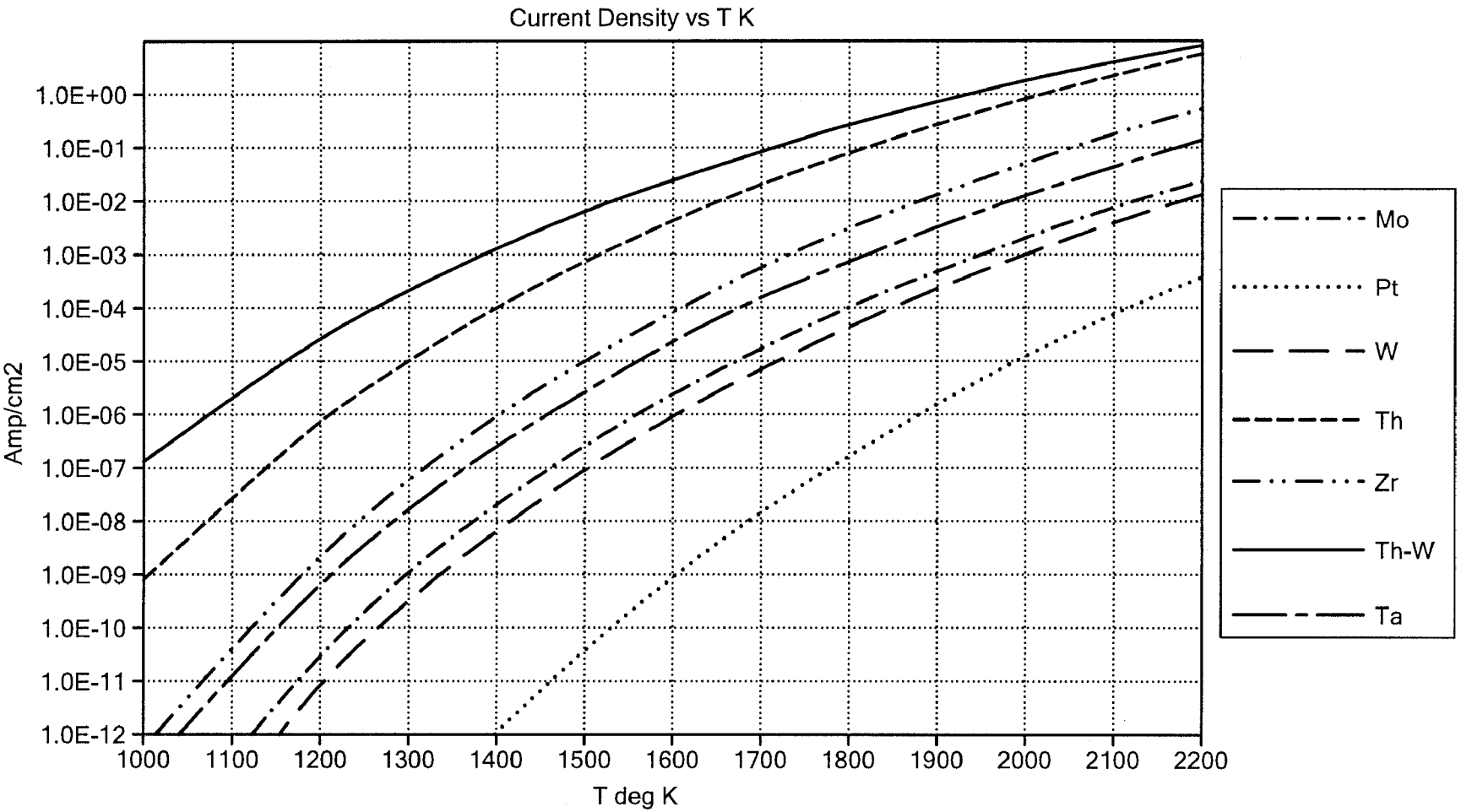
FIG. 6 (Prior Art)
FIG. 6 is a chart showing emissivity of various metals as a function of temperature, according to the prior art.

FIG. 6 is a graph showing emissivity of various metals as a function of temperature. As shown in the chart, the emissivity of platinum or tantalum is several orders of magnitude less than that of thoriated tungsten, at normal operating temperatures of about 1,800-2,200° K. Other suitable passivating materials (including materials not listed in the graph of FIG. 6) may be chosen, depending on the degree of passivation required.

Temperature-related factors may be considered when choosing a passivation material. For example, while platinum has a higher work function than tantalum (and, therefore, is a more effective passivator), platinum has a lower melting temperature (about 1,770° C.) than tantalum. Furthermore, tantalum forms a carbide at temperatures normally used to activate thoriated tungsten. The tantalum carbide offers protection for the tantalum and has a melting temperature above about 3,800° C.

A cathode with a passivated area has at least two desirable features. First, such a cathode has a well-defined emission area. The remainder of the cathode area is passivated; thus, for all intents and purposes, no, or significantly less, thermionic emissions take place from the passivated area. Second, a surface that is covered with platinum or tantalum is more resistant to damage from ion bombardment.

A miniature x-ray tube typically requires only about 10-100 microamperes of current. The small emission portion of the cathode, i.e., the activated tungsten portion, is large enough to provide the required current. For example, the graph in FIG. 6 shows that, at about 1,800° K, a cathode is capable of giving off about 0.5 amperes per square centimeter. In the example x-ray tube discussed above, with respect to FIGS. 1-4, a 150 μm diameter emitting area is capable of providing about 8 microamperes.

While the invention is described through the above-described exemplary embodiments, it will be understood by those of ordinary skill in the art that modifications to, and variations of, the illustrated embodiments may be made without departing from the inventive concepts disclosed herein. For example, although a tubular x-ray source is described, a spherical or other shaped housing may be used, depending on an intended use of the x-ray source. Moreover, disclosed aspects, or portions of these aspects, may be combined in ways not listed above. Accordingly, the invention should not be viewed as being limited to the exemplary embodiments.

What is claimed is:

1. An x-ray source, comprising:

a housing;

a cathode, disposed within the housing, the cathode having an area and a passivation layer over only a portion of the area of the cathode, leaving an emission portion of the cathode that is not covered by the passivation layer, wherein the emission portion has an area that is substantially smaller than the area of the cathode;

an anode spaced apart from the cathode and adapted for a voltage bias with respect to the cathode for accelerating electrons emitted from the cathode; and an x-ray emitter target disposed within the housing and spaced apart from the cathode for impact by the accelerated electrons.

2. An x-ray source, as defined in claim 1, wherein the passivation layer comprises a pyrolytic material.

3. An x-ray source, as defined in claim 1, wherein the passivation layer comprises platinum.

4. An x-ray source, as defined in claim 1, wherein the passivation layer comprises tantalum.

5. An x-ray source, as defined in claim 1, wherein the cathode further comprises a thoriated tungsten layer.

6. An x-ray source, as defined in claim 5, wherein the portion of the cathode that is not covered by the passivation layer is activated.

7. An x-ray source, as defined in claim 6, wherein the activated portion of the cathode comprises a carbon layer.

8. The x-ray source of claim 1, wherein the emission portion of the cathode has a circular shape with a diameter of about 150 μm.

9. A method for manufacturing a cathode for an x-ray source, comprising:

providing a base layer having an area; and passivating only a portion of the area of the base layer, thereby defining an emission portion of the base layer, wherein the emission portion has an area substantially smaller than the area of the base layer.

10. A method, as defined in claim 9, wherein the passivating the portion of the base layer comprises applying a pyrolytic material to the portion of the base layer.

11. A method, as defined in claim 9, wherein the passivating the portion of the base layer comprises applying platinum to the portion of the base layer.

12. A method, as defined in claim 9, wherein the passivating the portion of the base layer comprises applying tantalum to the portion of the base layer.

13. A method, as defined in claim 9, wherein providing the base layer comprises providing a thoriated tungsten layer.

14. A method, as defined in claim 13, further comprising activating at least an emission portion of the thoriated tungsten layer.

15. A method, as defined in claim 14, wherein activating the emission portion of the thoriated tungsten layer comprises activating the emission portion with carbon.

16. The method of claim 9, wherein the emission portion of the cathode has a circular shape with a diameter of about 150 μm.

* * * * *